United States Patent [19]

LaBelle et al.

[11] Patent Number: 4,917,368

[45] Date of Patent: Apr. 17, 1990

[54] SHEET FEEDING METHOD AND APPARATUS

[75] Inventors: Theodore J. LaBelle, Dorchester; Kenneth A. McAuley, Boston; George P. Ward, Jr., Danvers, all of Mass.

[73] Assignee: Polaroid Corporation, Cambridge, Mass.

[21] Appl. No.: 324,036

[22] Filed: Mar. 16, 1989

[51] Int. Cl.[4] ..... B65H 3/30

[52] U.S. Cl. ..... 271/21; 271/10; 271/19; 271/22

[58] Field of Search ..... 271/10, 19, 21, 22

[56] References Cited

U.S. PATENT DOCUMENTS

| | | | |
|---|---|---|---|
| 3,406,961 | 10/1968 | Walton | 271/10 |
| 3,588,092 | 6/1971 | Dubas | 271/19 |
| 3,768,807 | 10/1973 | Spengler | 271/190 |
| 3,813,094 | 5/1974 | Walton et al. | 271/10 X |
| 4,157,823 | 6/1979 | Morton | 271/10 |
| 4,231,563 | 11/1980 | Boucraut | 271/105 X |
| 4,579,329 | 4/1986 | Frost et al. | 271/10 |
| 4,776,575 | 10/1988 | Mayer et al. | 271/33 |
| 4,802,662 | 2/1989 | Hobbelt et al. | 271/19 X |

*Primary Examiner*—Kevin P. Shaver
*Assistant Examiner*—Boris Milef
*Attorney, Agent, or Firm*—Karl Hormann; Robert F. Ziems

[57] ABSTRACT

A sheet feeding method and apparatus particularly suited to handling plastic sheets having a tendency to adhere to each other under electrostatic action, in which the uppermost sheet of a stack is fed by first lifting the rear edge of the sheet into a generally arcuate configuration and translating a lifting member forwardly under the lifted rear edge to progressively separate the uppermost sheet from the rest of the stack. The lifting members preferably in the form of an idler roller which translates to a position in cooperation with a drive roller so that the sheet becomes sandwiched between the tow rollers for final feeding from the stack. The mechanism features a pick assembly particularly suited for engaging and lifting the rear edge of each sheet into a predictable arcuate configuration.

23 Claims, 7 Drawing Sheets

SHEET FEEDING METHOD AND APPARATUS

BACKGROUND OF THE INVENTION

This invention relates to separation and feeding of individual sheets from a stack to a point of transfer for use. More particularly, it concerns a sheet feeding method and apparatus particularly suited to handling sheet media of a nature which resists separation of individual sheets from a supply stack, such as plastic sheets which adhere to each other by electrostatic attraction.

Feeding systems for sheet media such as paper have reached a high level of reliability as evidenced by their extensive use in copy machines, high speed printing equipment and the like. Typically, such applications involve the use of calendared paper which facilitates separation of the uppermost sheet in a stack by little more than a friction roller capable of sliding the sheet relative to the remainder of the sheets in the stack. On the other hand, forces tending to resist this basic feeding technique, such as air pressure and mechanical engagement of fibers in paper media, have been recognized and addressed by employing an adhesive sheet lifting arrangement to initially separate the individual sheet to be fed from the remainder f a supply stack. In this respect, U.S. Pat. No. 4,776,575 13 Meyer et al., is representative.

Also, sheet feeders have been devised for handling textile fabrics, which because of their tendency to adhere to each other and also because of their relatively flimsy or non-resilient character, require lifting and separation as an incident to individual sheets being fed from a supply stack. Such arrangements are shown in U.S. Pat. Nos. 3,768,807 —Spangler and 4,231,563 —Boucraut. As taught by these prior patents, textile sheets are separated and fed from a stack by first lifting the trailing edge of the top sheet to be fed using a vacuum pickup and then passing a lifting bar or its equivalent under the lifted trailing edge of the sheet so that the full sheet will be progressively placed against a further vacuum device for lateral feeding.

While the general state of the art relating to sheet separation and feeding is quite developed and sophisticated, it is not known that a reliable system has been devised for handling sheet media of plastic material such as polyester and the like. Plastic sheet media exhibit several characteristics which render known feeding systems virtually ineffective for separation and feeding of individual plastic sheets from a stack. For example, such plastic sheet materials have a very low coefficient of friction, making it difficult to rely on friction to achieve a lateral feeding of one sheet from the remainder of the stack. Also, the relatively non-porous nature of plastic sheet media tends to preclude the presence of any air between the sheets so that atmospheric pressure operates to retain the sheets of a supply stack against individual sheet separation. Finally, and perhaps most significantly, plastic sheet media, being insulative or dielectric, are susceptible to relatively large electrostatic charges by which the individual sheets are attracted to each other under forces which must be overcome if one sheet is to be separated and fed from the stack.

In many applications such as laser photography which require a plastic substrate in sheet form, there is a need for a capability for supplying individual sheets of plastic media to a workstation at relatively high rates of feed. Because of the aforementioned problems with feeding plastic sheet media from a stack, however, no known sheet feeding systems are acceptable for this purpose. Accordingly, there is an acute need for an effective method and apparatus for separating and feeding individual plastic sheets from a supply stack.

SUMMARY OF THE INVENTION

In accordance with the present invention, a method and apparatus is provided by which individual sheets of media such as plastic may be separated and fed from a supply stack by engaging the rear edge of the uppermost sheet in a stack in a manner to flex the rear end portion of that sheet to an elevated position above the next sheet in the stack, translating a lifting roller under the flexed uppermost sheet to positively separate same from the rest of the stack and moving the lifting roller into a pressure nip relationship with a driving roller to feed the separated sheet from the stack.

In a preferred embodiment of apparatus for practicing the invention, the uppermost sheet of a supply stack of plastic media is separated by a pick member which translates in the direction of sheet feed to engage and lift the rear end of the uppermost sheet while the front end of the sheet is retained against translating movement. While the sheet is in this flexed condition with the rear end exhibiting a generally arcuate configuration, a lifting roller is translated against the underside of the flexed sheet to lift it from the stack progressively until the separating roller underlies and establishes a nip with a driven feed roller. Preferably the translated lifting roller, when in the nip relationship with the drive roller, is positioned forwardly of the drive roller so that the feeding direction of the sheet is upwardly and forwardly in a manner directing the front edge of the sheet over the retaining stop and feed it to a handling station.

The pick structure is designed to conform to the thickness of the individual sheets being handled and is further provided with an extended portion overlying the sheet to be separated in a manner causing a controlled flex radius in the sheet to be lifted. Because of this pick arrangement, proper flexure at the rear end of the sheet is assured. Moreover, the drive roller arrangement is arranged so that when in its inoperative or non-driving condition, the non-rotating drive roller rests against the forward portion of the uppermost sheet in the stack to resist buckling at that region and to confine flexure to the rear end portion of the sheet.

Among the objects of the present invention are, therefore, the provision of an improved sheet separation and feeding method and apparatus particularly though not exclusively adapted to resilient sheets of plastic media; another object of the invention is the provision of an improved pick arrangement for separating and flexing the uppermost sheet in a supply stack of plastic media; another object is the provision of an improved apparatus for assuring reliability of plastic sheet media separation and feeding in relation to a supply stack.

Other objects and further scope of applicability will be apparent from the detailed description to follow taken in conjunction with the accompanying drawings in which like reference numeral designate like parts.

DETAILED DESCRIPTION OF THE PREFERRED EMBODIMENTS

Figure 1:
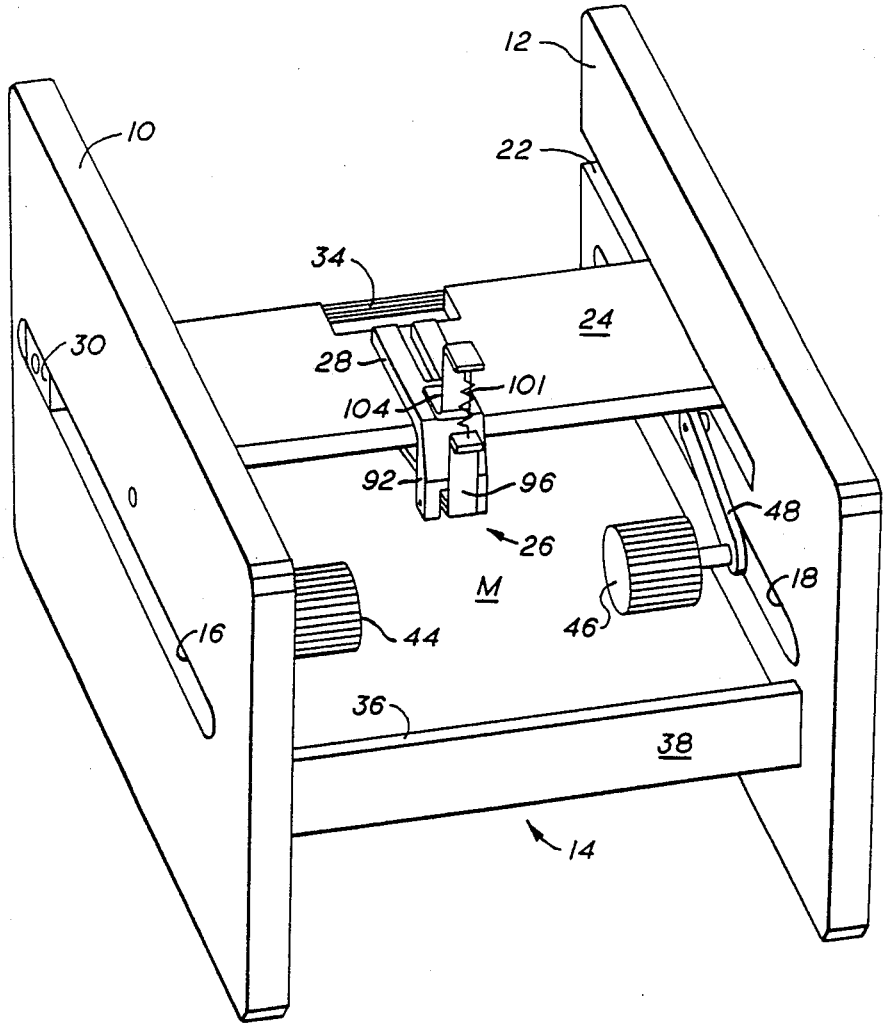
FIG. 1 is a perspective view illustrating the major operating components of the apparatus of the invention.
Figure 2:
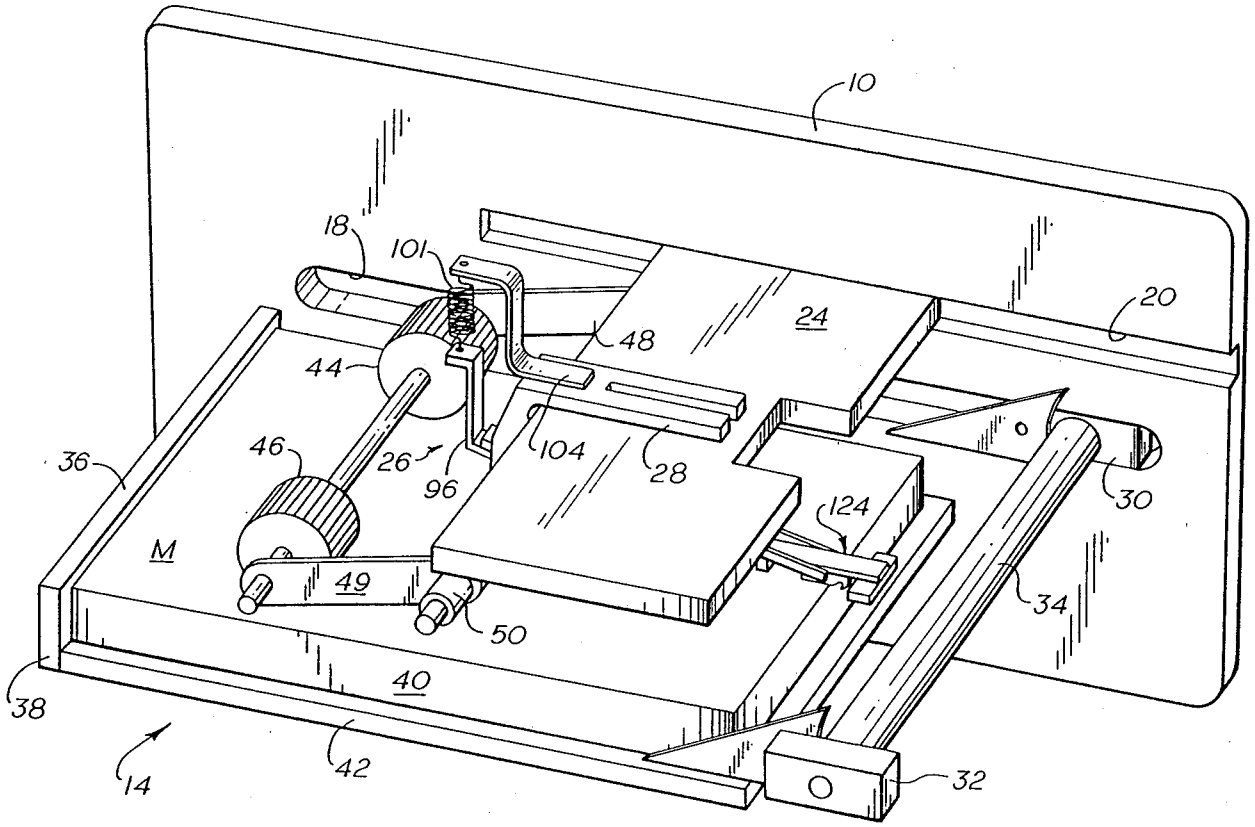
FIG. 2 is an isometric view showing the apparatus of FIG. 1 from the opposite end and with one supporting side plate removed to show operating components more clearly.

The general organization of major working components used in exemplary embodiments of the present invention is illustrated in the drawings. Thus in FIGS. 1 and 2, an overview of the illustrated embodiment reveals a supporting frame established by a pair of substantially identical side plates 10 and 12 interconnected by a media support 14. Each of the side plates 10 and 12 is formed with an elongated guide slot 16 and 18, respectively. As shown, the guide slots 16 and 18 are located generally intermediate the height or vertical dimension of the plates 10 and 12 and extend for a substantial portion of the length of the plates. Elevated slightly above the slots 16 and 18 on the inboard side of each plate 10 and 12, and opening through the rear end of each side plate, is an elongated guide groove 20 and 22, respectively, (FIGS. 1 and 2).

Slidably supported for longitudinal movement in the guide grooves 20 and 22 is a generally rectangular carriage plate 24. The carriage plate 24 supports a pick assembly 26 including a generally L-shaped assembly mount 28 adapted to be secured to the upper surface of the carriage plate 24 for limited fore and aft adjustment by suitable securing means such as bolts (not shown). A more complete description of the pick assembly 26 will appear below.

Slidably received for movement within the guide slots 16 and 18 is a pair of carriage blocks 30 and 32, respectively. The carriage blocks 30 and 32, in turn, support a freely rotatable or idling roller 34 for lifting individual sheets of medium in the manner to be described, which extends for substantially the distance between the plates 10 and 12. By virtue of the location of the guide slots 16 and 18, the lifting roller 34 is positioned slightly above the uppermost plane of the support 14 and any sheet media positioned thereon, such plane being established by the top edge 36 of a vertical wall 38 positioned at the forward edge of sheet media M to be fed from a stack 40 supported on a floor plate 42 of the support 14.

Each of the side plates 10 and 12 support one of a pair of drive rollers 44 and 46 coaxially mounted in a shaft 47 and positioned toward front or leading edge of the supply stack 40 as delimited by the wall 38 of the support 14. The drive rollers 44 and 46 are of identical construction and are rotatably supported at one end of pivot links 48 and 49, the other end of which is supported by journal bushings 50 extending into an appropriate bearing (not shown) in the respective side plates 10 and 12.

Figure 3:
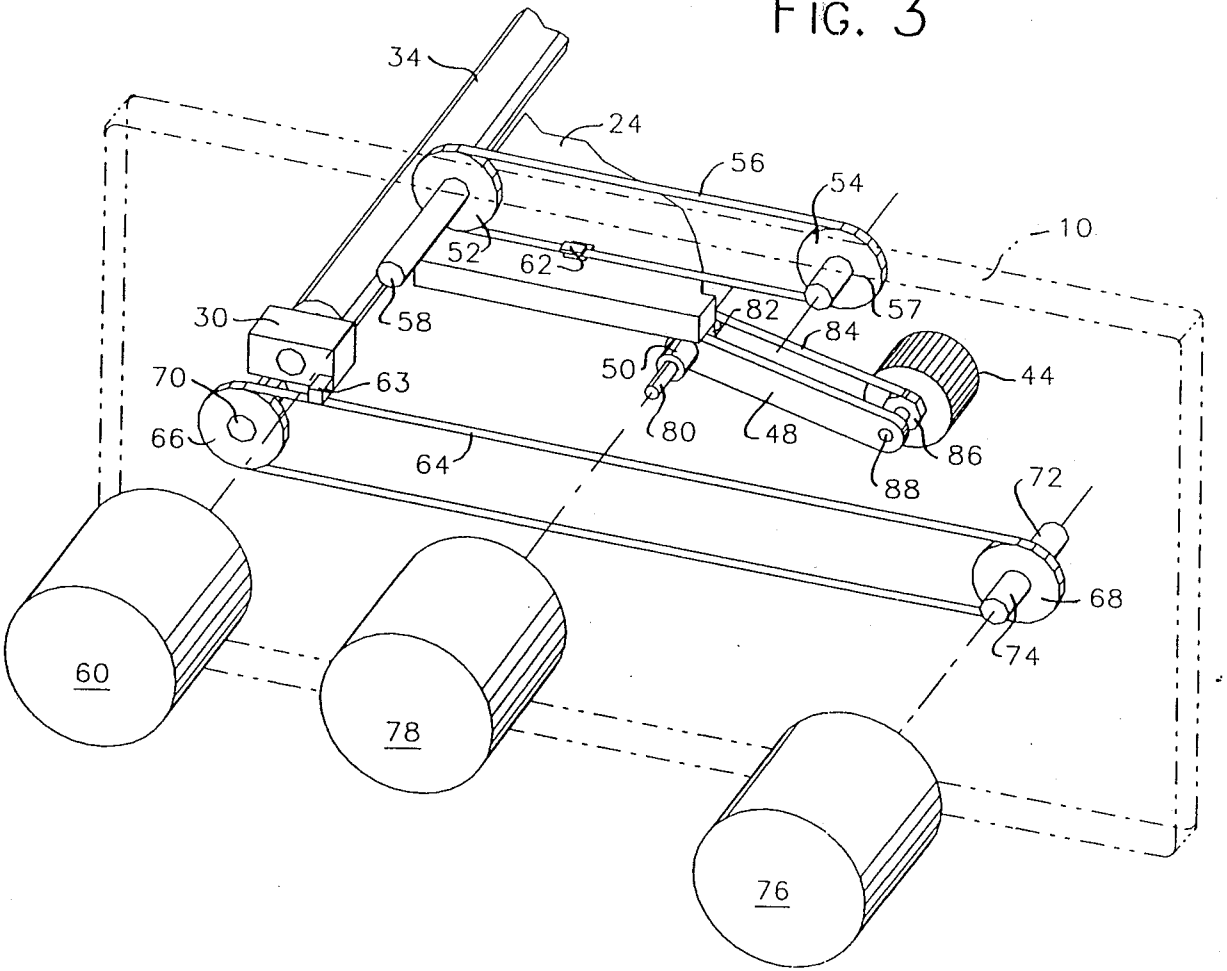
FIG. 3 is a fragmentary isometric view illustrating a drive mechanism for the apparatus illustrated in FIGS. 1 and 2.

In FIG. 3 of the drawings, driving components for translating the carriage plate 24, the carriage blocks 30 and 32 and thus the lifting roller 34, as well as for rotatably driving the drive rollers 44 and 46 are schematically illustrated in relationship to the side plate 10. It will be understood that the relationship of the drive assembly with side plate 10 as illustrated in FIG. 3 may be substantially the same in its relationship with side plate 12.

Positioned on the inboard side of the plate 10 and elevated above the carriage plate 24 is a pair of spaced sprockets or pulleys 52 and 54 about which an endless belt or chain 56 is trained. Both pulleys 52 and 54 are journalled in the side plate 10. The pulley 54 is an idler pulley supported by a shaft 57 journalled freely in the side plate 10. The pulley 52, on the other hand, is coupled for rotation with a shaft 58 which extends through the side plate 10 in a fashion to support the pulley 52 and to be drivably coupled to a rotatable driving device such as a stepping motor 60. The lower flight of the endless belt 56 is secured to the upper surface of the carriage plate 24 by a coupling bracket 62. It will thus be seen that rotation of the shaft 58 and pulley 52 by the motor 60 will cause linear or longitudinal movement of the belt 56 with attendant translating movement of the carriage 24 as a result of the connection thereof to the belt 56 by the bracket 62.

The lifting roller carriage blocks 30 and 32 are similarly driven through translatory movement in the guide slots 16 and 18 by connection of each block 30, 32 through a bracket 63 to an endless drive chain or belt 64 trained about a pair of longitudinally spaced sprockets or pulleys 66 and 68 positioned on the outboard side of the side plate 10. The pulley 66 is an idler pulley on a shaft 70 journalled for free rotation within the side plate 10 whereas the pulley 68 journalled by a shaft 72 in the side plate 10, is coupled by an extension 74 of the shaft 72 with a stepping motor 76.

Power for driving the drive roller 44 is supplied by a further stepping motor 78 coupled with a shaft 80 extending through and concentric with the support bushing 50 for the link 48 on which the roller 44 is rotatably supported. The shaft 80 is keyed to a drive pulley 82 about which an endless belt 84 is trained. The belt also is trained about a pulley 86 keyed to a shaft 88 by which the drive roller 44 is journalled in the end of the link 48. It will be appreciated that rotatable driving torque supplied by the stepping motor 78 may be transmitted to rotate the drive roller 44 while at the same time permitting pivotal movement of the link 48 on the axis of the bushing 50 by which it is supported in the side plate 10.

Figure 4:
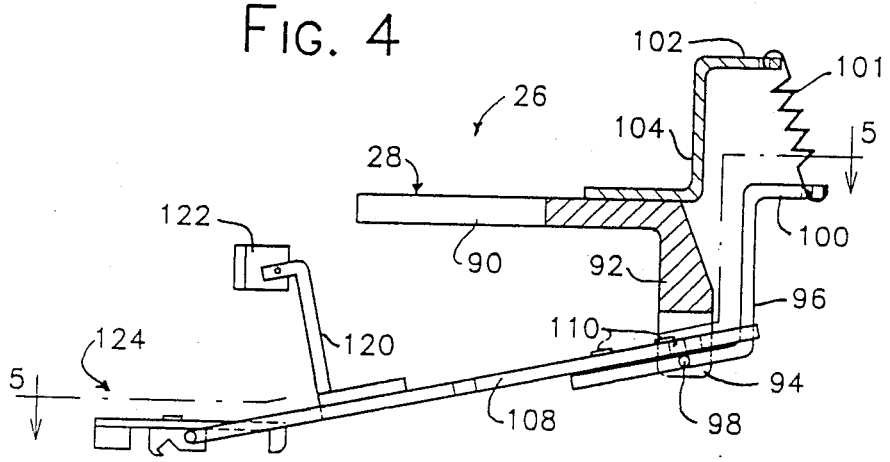
FIG. 4 is a side elevation in partial cross section illustrating the pick assembly of the present invention.

A more complete understanding of the structural components included in the assembly 26 may be had by reference to FIGS. 4–7 of the drawings. In FIG. 4, the overall assembly 26 is illustrated with the mount 28 in partial cross-section. The mount 28 is of generally L-shaped configuration to include a bifurcated mounting leg 90 and a depending leg 92 defining a yoke 94 at its lower end. A bell-crank pivot member 96 is fulcrumed on a pin 98 extending through the yoke 94 and extends to an elevated spring tab 100. The tab 100 is connected by a tension spring 101 to a similar tab 102 on a bracket 104 fixed to the top of the mount 28.

A pick arm 108 is adjustably secured to the pivot member 96 as by screw bolts 110 extending through slots 112 in the arm 108. In an alternate arrangement, not shown, the pivot member 96 and the pick arm 108 may be an integral unit. Lateral positioning of the pick arm 108 with relation to the pivot member 96 is effected in some measure by a mounting yoke 114 positioned a one end of the arm 108. The end of the pick arm 108 opposite from the mounting yoke 114 is widened to establish a platform 116 terminating in a pick supporting yoke 118. The platform 116 supports a bracket 120 for an optical sensor 122 (FIG. 4). A pick 124 is pivotally supported by a pin 126 extending through both the pick 124 and the yoke 118 on the arm 108.

Figure 6:
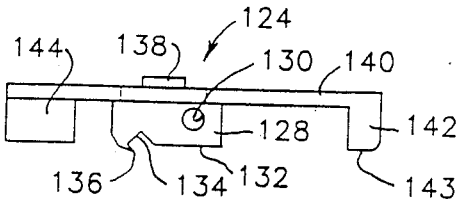
FIG. 6 is a side elevation of the pick device of the invention.
Figure 7:
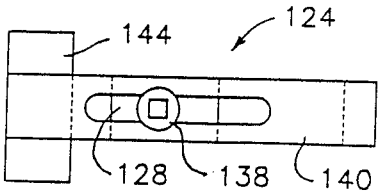
FIG. 7 is a top plan view of the pick device.

As shown most clearly in FIGS. 6 and 7 of the drawings, the pick 124 includes a pick body in the form of a block 128 having a pivot aperture 130 through which the pin 126 extends. The block 128 is formed with a bottom planar surface 132 which ends rearwardly in an angled generally rectangular slot 134. The slot 134 is inclined with respect to the bottom surface 132 at an angle approximating 45° so that the lower rearwardly inclined surface of the slot defines at its front edge, a pick claw with a linear tip 136 which extends below the surface 132 by the approximate thickness of a single sheet of medium to be fed by the apparatus of the invention. Adjustably secured to the pick block 128 by a bolt 138 is a pick block extender 140 which includes a depending portion 142 with a bottom surface 143 which lies in the plane of the surface 132 on the pick block 128. Supported under the forward end of the extension 140 is a balancing weight 144.

Figure 8:
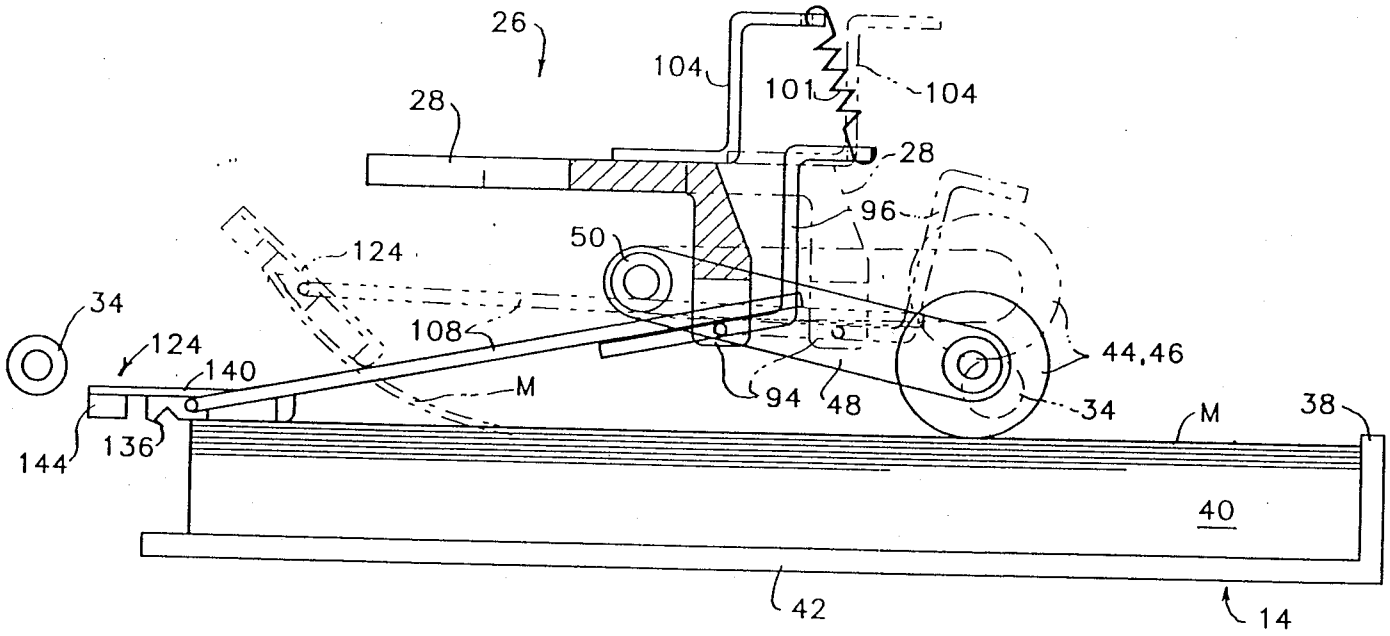
FIG. 8 is a side elevation similar to FIG. 4 but illustrating the major operating components of the invention in solid and phantom lines representing respective end limits of component movement.

In FIG. 8 of the drawings, the several working components described above are shown relative to each other and to the supply stack 40 in extreme positions of movement represented respectively by solid and phantom line illustration. The pick assembly 26, by virtue of its being carried by the carriage plate 24, will be moved from the solid line position of the mount 28 to the phantom line position shown. In the position represented by solid lines in FIG. 8, the surfaces 132 and 143 (FIG. 6) of the block 128 and depending portion 142 rest against the top of the uppermost sheet to position the claw 136 near the bottom of the sheet. A combination of the weight of the pick 124, the position of the balance weight 144, and the tension spring 101 assures this positioning. Movement of the mount 28 will result in movement of the pick arm 108 and pick 124 from the rear end of the stack 40 to the elevated position shown in phantom lines. The lifting roller 34, initially positioned behind and slightly above the rear end of the supply stack 40 is translated to a position underlying the drive rollers 44, 46. As a result of the support of the drive rollers 44, 46 on the pivot links 48, the drive rollers swing upwardly to establish a feed nip with the lifting roller 34.

Figure 9:
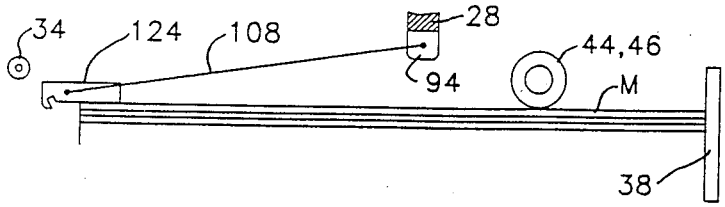
FIGS. 9–13 are schematic views illustrating motion of major operating components in relation to a supply stack of sheet media during successive phases of individual sheet separation and feeding.
Figure 10:
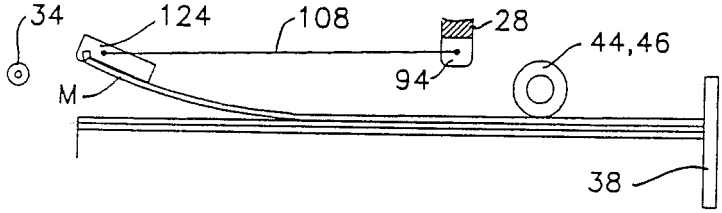

Operation of the apparatus described may be appreciated from FIGS. 9–13 of the drawings. In FIG. 9, the positions of the lifting roller 34, pick 124, and drive rollers 44, 46 are essentially the same as that represented by the solid line illustration in FIG. 8. At the initiation of a sheet feeding cycle, the carriage 24 and pick assembly mount 28 are first moved to advance the pick 124 against the rear edge of the uppermost sheet M in the supply stack 40. Forward movement of the pick 124 coupled with retention of the uppermost sheet against translating movement at this time by the front wall 38 of the media support 14 will result in the rear end of the sheet M being lifted in the manner illustrated in FIG. 10. During this initial lifting, the relatively light weight of the rollers 44, 46 on top of the sheet forwardly of the region of lifting tends to prevent buckling of the uppermost media sheet M under the forward component of force exerted by movement of the pick 124.

Figure 11:
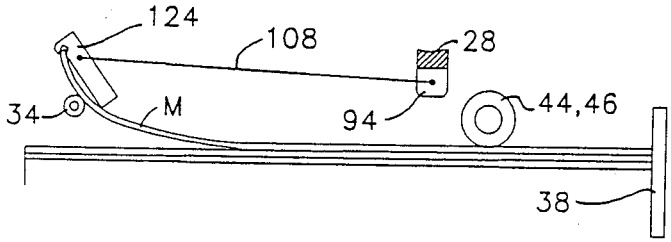
Figure 12:
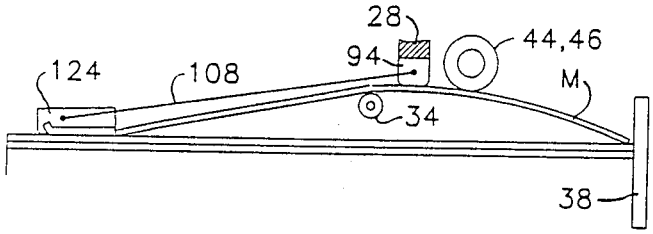

When the pick assembly mount 28 reaches its forwardmost position as represented in phantom lines in FIG. 8 and also in FIG. 11, the rear end of the sheet M will be flexed to a generally arcuate configuration shown in FIG. 11. In this respect, the specific configuration of the lifted sheet will vary with different sheet media and such variations may be accommodated by adjusting the position of the pick extension 140 with respect to the pick block 128. In other words, the depending portion 142 of the pick extension 140 cooperates with the point 136 on the pick to develop a lever effect on the sheet media M in a manner to determine the nature of the curved configuration to which the uppermost sheet is lifted.

Figure 5:
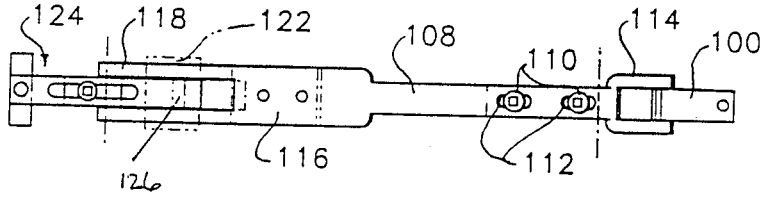
FIG. 5 is a cross section on line 5—5 of FIG. 4.

Although the sensor 122 described with reference to FIGS. 4 and 5 is not depicted in FIG. 11, its location on the arm 108 is such that when the pick 124 is pivoted to the position of FIG. 11, the sensor 122 will operate to detect the presence of the elevated rear end of the sheet M. The sensor 122 is an optical sensor having a source of light and a light detector so that a sensing signal may be developed by reflection of light from the lifted sheet.

As the medium M is lifted to the position shown in FIG. 11 the lifting roller 34 is translated from its initial position under the rear end of the sheet M and against the underside of the arcuately constrained portion of that sheet as shown in FIG. 11. Such movement of the lifting roller 34 continues while the pick mount 28 is stationary to separate the uppermost sheet progressively from the adjacent underlying sheet to a generally arcuate configuration shown in FIG. 12. The drive rollers 44 and 42 will be lifted by the upwardly curved sheet M, also shown in FIG. 12.

Figure 13:
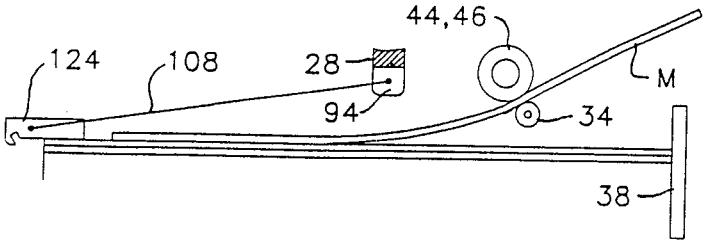

In the final position of the lifting roller 34 as shown in FIG. 13, the sheet M is engaged between the drive rollers 44, 46 and the lifting roller 34 with the latter position slightly forwardly of the axis of the drive rollers. As a result of this latter condition, the direction of feed by rotation of the drive rollers 44, 46 is forwardly and upwardly in a manner to clear the upper surface of the wall 38.

It is to be noted that under certain conditions, the resiliency of the sheet M will allow the front end thereof to snap past the wall 38 to the position shown in FIG. 13. It is preferred, however, that when the drive rollers 44, 46 and lifting roller 34 reach the relative position shown in FIG. 13, that rotation of the drive rollers 44, 46 be reversed briefly in order first to draw the sheet away from the wall 38 and then to feed it in the line represented in FIG. 13.

The embodiment described supra is provided with a floor plate 42 for supporting a stack 40 of sheets which preferably is automatically adjusted in its height as individual sheets M are fed from the stack 40 such that regardless of the number of sheets M in the stack 40 the level of its upper surface remains substantially constant at all times.

Figure 14:
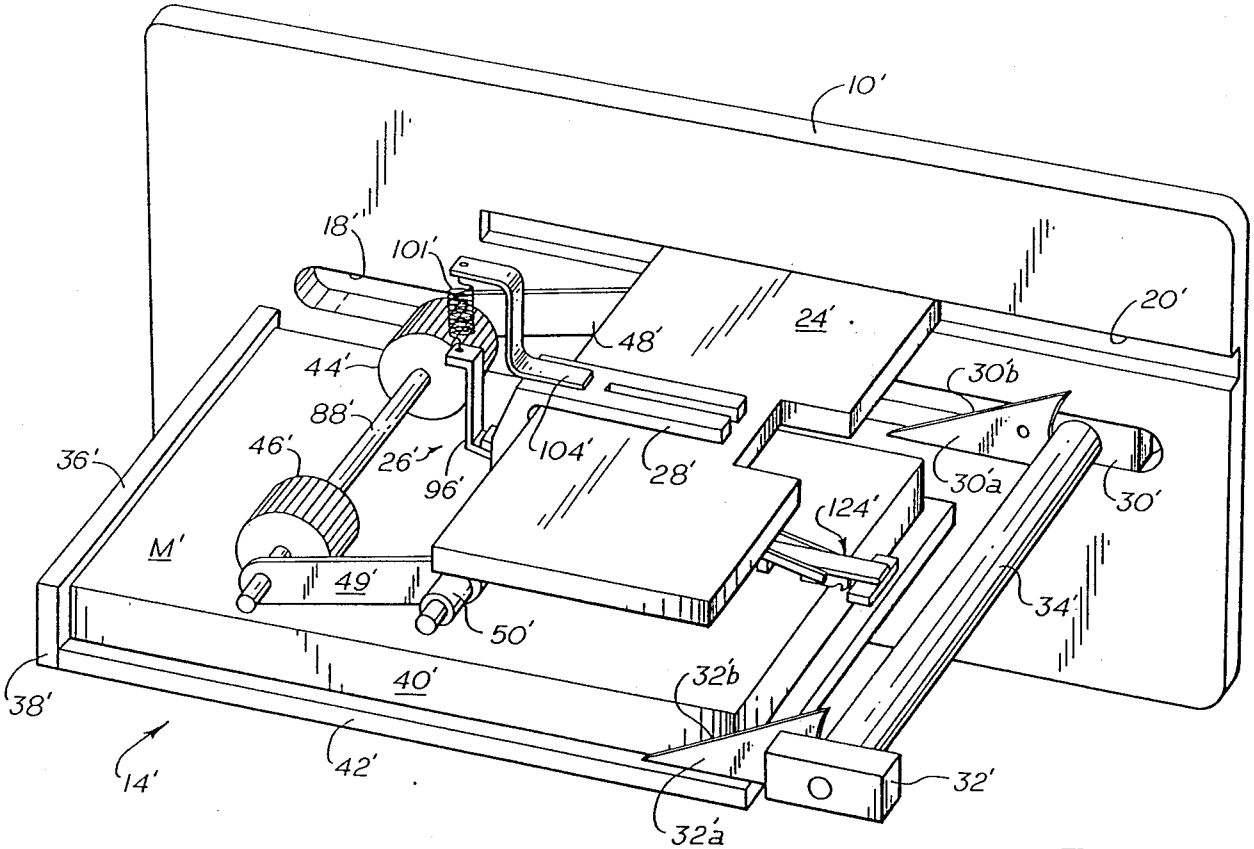
FIG. 14 is an isometric view similar to that of FIG. 2 but showing an alternative embodiment of the invention.

FIG. 14 depicts another embodiment of the invention which resembles the previously described one in major respects, in function as well as structure. It is different, however, in that it does not provide for the adjustment in height of the stack of sheets. To the extent its structural elements are similar to those shown in the drawings of the previously described embodiment they are identified by similar but primed reference characters.

In the alternative embodiment, each of the carriage blocks 30' and 32' is provided with a wedge-like extension 30*a* and 32*a*, respectively, having camming surfaces 30*b* and 32*b*. The camming surfaces 30*b* and 32*b* face in the direction of the drive rollers 44' and 46'. The drive rollers 44' and 46' are mounted on pivot links 48' and 49' by a common shaft 88' with stubs 88*a* thereof protruding sufficiently beyond the pivot links 48' and 49' to be engageable by the camming surfaces 30*b* and 32*b* of the extensions 30*a* and 32*a* as described infra.

As the pivot links 48' and 49' may pivot freely about their shaft 80', the drive rollers 44' and 46' will always rest on the upper surface of the stack 40' of sheets M' positioned on the floor plate 42'. The weight of the rollers 44' and 46' is sufficient to hold down the sheet M' to prevent its forward edge from prematurely escaping over the top edge 36' of the vertical wall 40' as the pick 124' grasps the trailing edge of the uppermost sheet M' in the stack 40' and flexes it upwardly in the manner described in connection with FIGS. 9–13.

The lifting roller 34' then moves under the sheet M' flexed upwardly by the pick 124' in the direction of the drive rollers 44' and 46'. As the lifting roller 34' approaches the drive roller 44' and 46' the camming surfaces 30*b* and 32*b* move under the stubs 88*a* to lift the drive rollers 44' and 46' upwardly but their engagement with the upper surface of the sheet M' is maintained as the lifting roller 34' pushes the sheet M' in an upward direction.

Shortly after the drive rollers 44' and 46' have begun to move upwardly the forward movement of the pick 124' is reversed, and frictional forces between the pick 124' and the sheet M' cause the latter to be pulled back sufficiently to free its forward edge from the vertical wall 38' so that in the manner described in connection with the previous embodiment the sheet M' may be tilted upwardly as the lifting roller 34' moves forward of the axis of the drive rollers 44' and 46' (see FIG. 13).

In light of the foregoing, it will be appreciated that as a result of the present invention, an effective method and apparatus are provided for feeding plastic sheets which exhibit a substantial attraction to each other as a result of electrostatic forces, and by which the stated objects of invention among others may be fully realized. It will also be understood that modifications and variations may be made in the disclosed apparatus without departing from the invention.

For example, separate stepper motors 60, 78, and 76 have been shown for controlling movement of the lifting roller 34, the pick carriage 24 and the drive rollers 44, 46, but it is contemplated that the drive apparatus may vary substantially from the individual stepper motor arrangement shown. In addition, the support 14 in the described embodiment is represented by a simplified platform for the stack 40 of sheets. It is contemplated that follower mechanisms may be employed to elevate the stack so that the uppermost sheet remains at the same approximate level throughout feeding of the entire stack. Also cartridge arrangements may be substituted for the platform arrangement shown.

It is intended that the foregoing description is exemplary only, not limiting, and that the true spirit and scope of the present invention be determined by reference to the appended claims.

What is claimed is:

1. A sheet handling mechanism for separating and feeding the uppermost sheet from a stack of superposed sheets influenced by forces causing the sheets to be attracted to one another, each sheet having top and bottom surfaces and forward and rear edges, said mechanism comprising:

mechanical pick means including hook means for insertion under and lifting of the rear edge of the uppermost sheet from the remainder of the stack;

translatable lifting roller means for engaging the bottom surface of the uppermost sheet and for progressively peeling the uppermost sheet away from the remainder of the stack; and drive roller means positioned in the translating path of said lifting roller means for contacting the top surface of the uppermost sheet as it is sandwiched between said roller means to feed the uppermost sheet away from the remaining stack of superposed sheets.

2. The sheet handling mechanism of claim 1 wherein said pick means comprises a pick body having a lower surface to rest against the top surface of said uppermost sheet and a pick claw depending from said lower surface by the approximate thickness of said sheets.

3. The sheet handling mechanism of claim 2 wherein said pick body comprises a block having a planar lower surface, said claw being defined as a forwardly presented linear tip near the rear end of said block.

4. The sheet handling mechanism of claim 3 wherein said block includes a rearwardly inclined slot to establish said linear tip.

5. The sheet handling mechanism of claim 4 wherein said pick means includes an extender secured to said pick body, said extender having a depending portion with a bottom face in the plane of said pick body lower surface.

6. The sheet handling mechanism of claim 5 wherein said extender is longer than said pick body in the longitudinal direction of sheet feed and is secured to the top of said pick body for relative longitudinal adjustment.

7. The sheet handling mechanism of claim 6 wherein said extender extends rearwardly of said pick body, said pick means including a balance weight secured to said extender rearwardly of said pick claw.

8. The sheet handling mechanism of claim 1 wherein said pick means comprises a pick body having a lower surface to rest against the top surface of said uppermost sheet and a pick claw depending from said lower surface by the approximate thickness of said sheets, an arm pivotally connected at one end to said pick body, and translatable means positioned above said pick body for longitudinal movement in the direction of sheet feed, the other end of said arm being pivotally connected to said translatable means, whereby movement of said translatable means in the direction of sheet feed results in engagement of the rear edge of said uppermost sheet by said pick claw followed by upwardly swinging movement of said arm to lift the rear edge of said uppermost sheet from the remainder of said stack into a generally arcuate configuration in the region in the rear edge of said sheet.

9. The sheet handling mechanism of claim 8 wherein the lower surface of said pick body and said claw establish a lever arm for controlling the arcuate configuration of said uppermost sheet.

10. The sheet handling mechanism of claim 9 wherein said pick body includes an adjustable extension for varying the effective length of said lever arm.

11. The sheet handling mechanism of claim 8 wherein said translatable means comprises a longitudinally movable carriage and mounting means adjustably positioned on said carriage, said other end of said arm being pivotally connected to said mounting means.

12. The sheet handling mechanism of claim 8 including abutment means for restraining movement of said uppermost sheet during movement of said translatable means.

13. The sheet handling mechanism of claim 12 wherein said drive roller means is supported for movement between an inactive position bearing on the forward portion of said uppermost sheet and an elevated active position, said drive roller means in said inactive position serving to restrain buckling of said uppermost sheet in the forward portion thereof during lifting movement of the rear end of said uppermost sheet.

14. The sheet handling mechanism of claim 13 including rearwardly extending pivotal links for supporting said drive roller means.

15. The sheet handling mechanism of claim 13 wherein said drive roller means is lifted to said inactive position by translating movement of said lifting roller means under the bottom surface of said uppermost sheet.

16. The sheet handling mechanism of claim 15 wherein said lifting roller means is movable between a retracted position above and behind the rear edges of said sheets in said stack and a forward working position slightly forward of said drive roller means so that feeding movement of said sandwiched uppermost sheet is in a forward and upward direction to clear said abutment.

17. The sheet handling mechanism of claim 16 including means for rotating said drive roller means in a preliminary reverse direction to draw the front edge of said uppermost sheet away from said abutment prior to forward feeding motion thereof.

18. The sheet handling mechanism of claim 16 wherein said lifting roller means is provided with means for raising said drive roller means upwardly.

19. The sheet handling mechanism of claim 18, wherein said means for raising comprises cam means engageable with said drive roller means adjacent said forward working position of said lifting roller means.

20. The sheet handling mechanism of claim 8 including sensor means mounted on said arm for detecting the presence of the lifted rear edge of said uppermost sheet.

21. The method of feeding sheets of resilient dielectric plastic material from a stack in which the sheets are attracted to each other under electrostatic forces, said method comprising the steps of:

engaging the rear edge of the uppermost sheet in a stack and flexing the rear end portion of said uppermost sheet to a curved configuration in which said rear edge is spaced substantially from the next sheet in the stack;

translating a freely rotatable roller against the flexed rear end portion of the uppermost sheet in a manner to separate that sheet progressively from the next sheet in the stack against a flexing bias exhibited by said uppermost sheet; and moving the freely rotatable roller into a pressure nip relationship with a driving roller positioned above the uppermost sheet to drivably feed the uppermost sheet from the stack.

22. The method of claim 21 including the step of restraining the front edge of said uppermost sheet against movement during flexing of the rear end portion thereof.

23. The method of claim 22 including the step of restraining the front portion of said uppermost sheet against buckling during flexing of the rear end portion thereof.

* * * * *